United States Patent [19]

Bittner

[11] 4,193,065

[45] Mar. 11, 1980

[54] GOLF SWING CONTROL ALARM

[76] Inventor: Louis M. Bittner, 1144 W. River Dr., Margate, Fla. 33063

[21] Appl. No.: 953,084

[22] Filed: Oct. 20, 1978

[51] Int. Cl.[2] ..... A63B 69/36; G08B 21/00

[52] U.S. Cl. ..... 340/323 R; 340/321; 340/573; 273/183 B; 35/29 A

[58] Field of Search ..... 340/323 R, 321, 686, 340/691, 692, 573; 273/183 B; 35/29 A

[56] References Cited

U.S. PATENT DOCUMENTS

| | | | |
|---|---|---|---|
| Re. 28,661 | 12/1975 | Tredway, Sr. | 340/321 |
| 3,243,186 | 3/1966 | Johnson | 340/323 X |

*Primary Examiner*—Donald J. Yusko

*Attorney, Agent, or Firm*—Malin & Haley

[57] ABSTRACT

A device for indicating to a golfer that the golfer's target control arm is being bent during a golf swing comprised of a housing having an electrical power supply and associated circuitry including a buzzer or light for generating a signal connected to a moveable member mounted by a hinge on the housing having an electrical contact disposed at one end. The moveable member and the housing are strapped about the golfer's arm that delivers the target control stroke such that the hinge axis is aligned over the elbow of the arm which is to be maintained in a straight line position during the golf swing. In addition, an illuminating device includes a cord which may be plugged into the housing such that the illuminating device may be positioned within the vision of the golfer during a golf swing to illuminate whenever the golfer's arm is not maintained in a straight position throughout the swing.

3 Claims, 5 Drawing Figures

GOLF SWING CONTROL ALARM

BACKGROUND OF THE INVENTION

One of the most common problems in developing the proper golf swing is to prevent movement from a straight line position of the arm that provides control during the swing. In a right handed golfer, the left arm is the control arm. It is often difficult for a golfer during the swing to actually realize particular movement of the control arm during the swing since the golfer is concentrating on striking the ball. The present invention provides a lightweight, easily mounted indicating device which will inform the golfer (either audibly or visually) that the golfer's arm is not being maintained in a straight position during the swing if the arm should move. Further, the device is sized in volume and weight such that the device itself does not interfere with the golf stroke.

BRIEF DESCRIPTION OF THE INVENTION

A device for providing either an audible or visual indication to a golfer during a golf swing that the straight line position of the golfer's target control arm is not being maintained comprising a housing, an electrically-actuated buzzer mounted within said housing, an electrical power supply mounted within said housing connected to said buzzer, a switch connected to said buzzer and said power supply mounted within said housing, and a female jack plug connected to said switch and said power supply. A moveable member is connected by a hinge at one end to said housing and is pivotably movable relative to said housing. Disposed at the inside end of said moveable member is an electrical contact. Inside said housing are a pair of electrical contacts that are connected to the power supply and switch. The two contacts inside the housing are spaced apart and positioned relative to the moveable contact such that in a first position with the hinge lying in the same plane as the back face of the housing, the contacts do not engage. However, in a second position with the moveable member at an angle to the plane of the back face of the housing, a contact position is reached when the slightest angular difference will allow the contact on the end of the moveable member to engage the pair of contacts in the housing which allows the circuit to be completed.

The housing and the hinge arm each contain an adjustable strap which is mounted about the control arm of the golfer. The straps may be conventional in design.

Additionally, a base member is included which has a socket and lightbulb mounted on it and electrical wiring connected to a jack plug which may be engaged in the housing receptacle. In this operation, the movement of the movable member and engagement of the contacts closing a circuit provide for illumination of the lightbulb which may be mounted near the feet of the golfer within his field of view during a golf swing.

The housing includes a three-way switch mounted thereupon which has an off position, a buzzer position, and an illuminating position for the lightbulb.

Power for the device is provided by a 1.5 volt DC battery which is mounted within the housing.

In operation, the housing and moveable member are strapped about the golfer's control arm that is desired to be maintained in the straight position. For a right handed golfer this would be his left arm. When the golfer is ready to commence the swing, the switch is turned to either the buzzer or the illuminate position, depending on which particular indication the golfer is to utilize. The golfer will then line up and swing in the conventional manner. Should the arm break or move slightly away from the established straight line position, the device will provide an audible buzzing noise or the lightbulb will illuminate during the swing, immediately notifying the golfer that the golfer's arm has moved to an incorrect position.

It is an object of this invention to provide a non-complex indicator for a golfer to notify the golfer if his arm position moves in an incorrect manner.

It is another object of this invention to provide a warning device for a golfer that tells him instantaneously during a golf swing that the arm position which is desired to be kept straight has moved to an incorrect position.

And yet, still another object of this invention is to provide a golf indicating device to indicate straight line departure of the arm which does not interfere with a normal golf stroke.

In accordance with these and other objects which will be apparent hereinafter, the instant invention will now be described with particular reference to the accompanying drawings.

PREFERRED EMBODIMENT OF THE INVENTION

Figure 1:
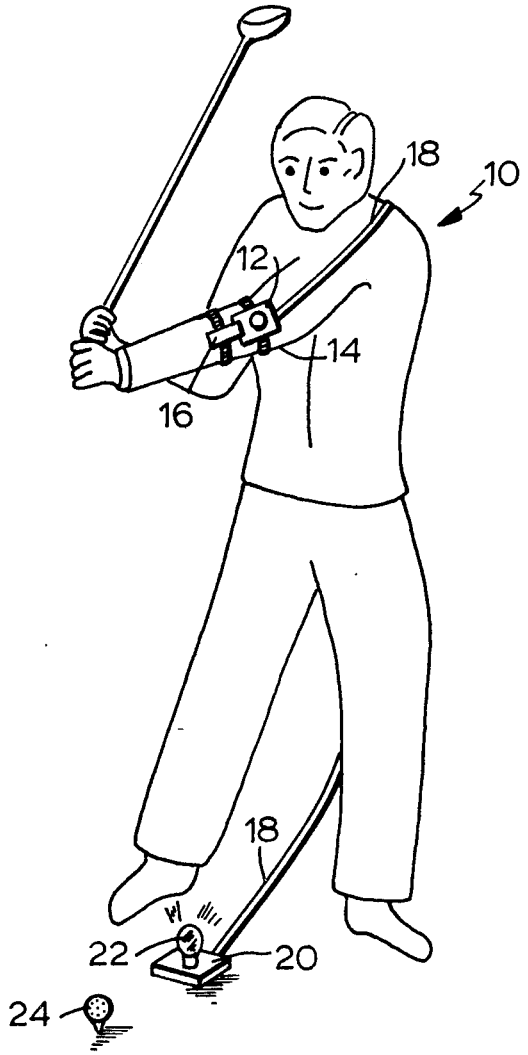
FIG. 1 shows a perspective view of a golfer utilizing the present invention.

Referring now to FIG. 1, the instant invention is shown generally at 10 attached to the golfer's left arm 14. The device includes a moveable member 16 which is also attached to the golfer's arm. The device is mounted such that the hinge between housing 12 and moveable member 16 are aligned to the elbow (where the golfer's arm pivots). Thus, the device is mounted between the pivotal movement axis between the upper portion of the arm and the lower portion of the arm. An electrical wire 18, which is connected to housing 12, is disposed over the shoulder of the golfer terminating in a support 20 upon which lightbulb 22 and socket are mounted. In FIG. 1, the golfer is addressing a conventional golf ball 24.

Figure 2:
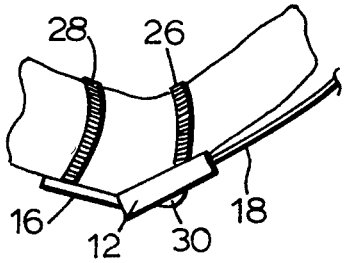
FIG. 2 shows a fragmentary view of a golfer's arm in an incorrect position with the instant invention attached thereto.

FIG. 2 shows the moveable member 16 pivotally moved relative to the back face of the plane of housing 12 which in this position indicates that the arm is bent which would provide an audio or visual indication to the golfer. Element 30 represents a buzzer disposed within the housing.

Figure 3:
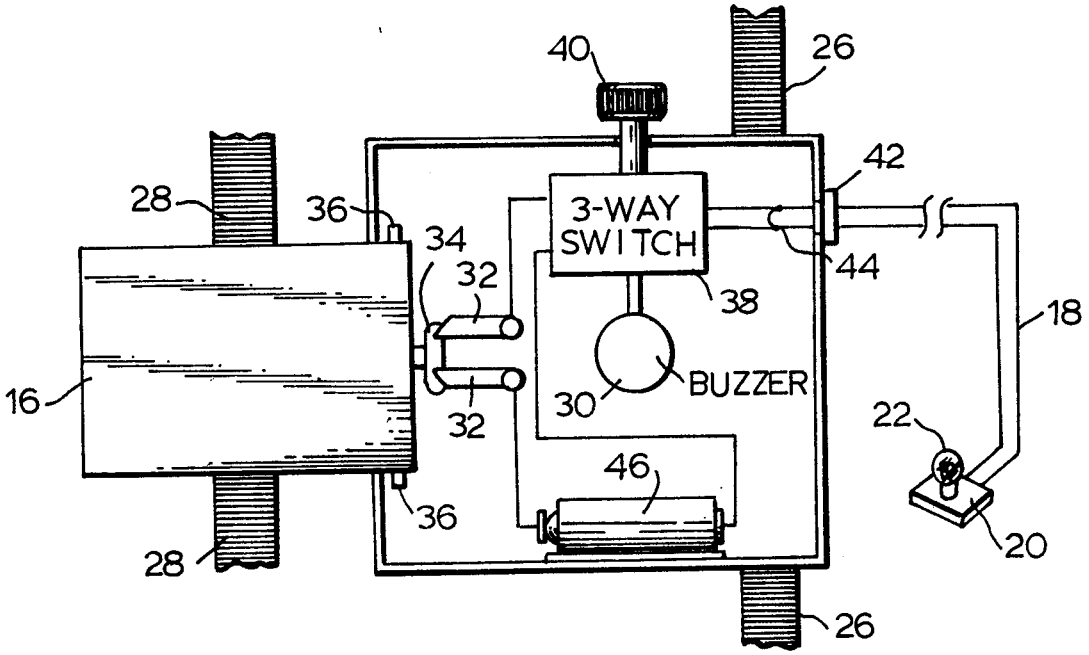
FIG. 3 shows a schematic diagram of the instant invention.

FIG. 3 shows the relationship between the primary contact 34 which is connected at the inner end of moveable member 16 mounted by hinges 36 to the housing. Within the housing is a buzzer 30 electrically connected to a three-way switch 38 having a knob 40 disposed on the outside of the housing. A battery 46 provides DC power for the buzzer or the lightbulb. Inside the housing are a pair of metal strips 32 which are connected in series with the battery and three-way switch. The strips 32 are separated so that when the strips are not engaged with contact 34, there is a break in the circuit and no power is received to the switch 38. The switch is also connected to a female plug 44 disposed in the housing. A male jack 42 is connected by wires 18 to lightbulb 22 mounted on support 20.

Figure 4A:
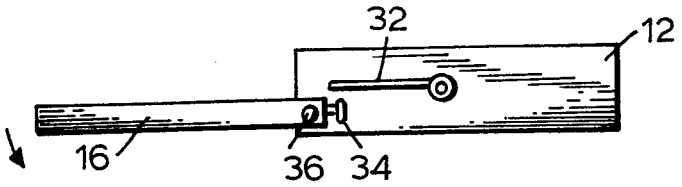
FIG. 4A shows the side elevational schematic diagram of a portion of the instant invention.
Figure 4B:
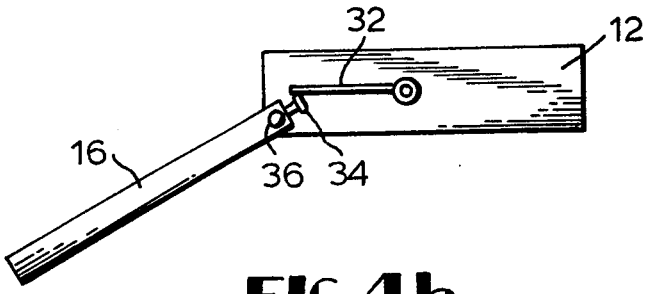
FIG. 4B shows a side elevational view of the schematic portion of the instant invention in which the moveable member is pivoted to a position to allow contact.

FIG. 4*a* shows the relationship when mounted on the arm when the arm is straight such that the surface of the moveable member 16 lies in the same plane as the lower surface of the housing. The contact strips 32 are disposed slightly above electrical contact 34. As shown in FIG. 4*b*, pivotal movement of the member 16 causes electrical contact 34 to complete an electrical circuit between the strips 32. This completes the circuit between the battery 46 and the switch 38 allowing the switch to be energized and if disposed to the buzzer 30 or to lightbulb 22 to provide power to either of these units.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for providing an indication to a golfer during a golf swing that one of the golfer's arms has moved from a substantially straight in line position to a bent position at the elbow comprising:

a housing;

a moveable member pivotally mounted at one end of said housing, said one lower surface of said member lying in the same plane as the surface of said housing in a first position;

an electrical contact connected at one end of said member within said housing;

an indicating means connected to said housing;

a power supply connected to said housing;

a means for completing the circuit between said power supply and said indicating means connected in said housing and disposed relative to said contact mounted on said member whereby in a first position said contact means does not engage said contact member when said member is in the same plane as the lower surface of said housing and which in a second position engages the contact to complete the circuit when said moveable member is in an angular position relative to the plane of the housing.

2. The device in claim 1, wherein:

said indicating means includes an audio generating means connected in said housing.

3. A device as in claim 1, wherein:

said indicating means includes an illuminating means electrically connected to said power supply and said contacts mounted within said housing.

* * * * *